US009761434B1

(12) United States Patent
de Santiago Garcia et al.

(10) Patent No.: US 9,761,434 B1
(45) Date of Patent: Sep. 12, 2017

(54) LAMP WITH INTERTWINED STRANDED POWER LEAD

(71) Applicants: Arturo de Santiago Garcia, El Paso, TX (US); Miguel Perez, Juarez (MX); Francisco Rodriguez Salamanca, Juarez (MX)

(72) Inventors: Arturo de Santiago Garcia, El Paso, TX (US); Miguel Perez, Juarez (MX); Francisco Rodriguez Salamanca, Juarez (MX)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 15/188,534

(22) Filed: Jun. 21, 2016

(51) Int. Cl.

| | |
|---|---|
| ***H01K 1/66*** | (2006.01) |
| ***H01K 1/40*** | (2006.01) |
| ***H01K 1/46*** | (2006.01) |
| ***H01K 1/38*** | (2006.01) |

(52) U.S. Cl.
CPC ..... *H01K 1/66* (2013.01); *H01K 1/38* (2013.01); *H01K 1/40* (2013.01); *H01K 1/46* (2013.01)

(58) Field of Classification Search
CPC .. H01K 1/66; H01K 1/40; H01K 1/46; H01K 1/38
See application file for complete search history.

(56) References Cited

U.S. PATENT DOCUMENTS

| | | | | |
|---|---|---|---|---|
| 1,736,820 | A * | 11/1929 | Black | F21S 6/001 313/116 |
| 3,465,197 | A | 9/1969 | Martin | |
| 3,733,508 | A | 5/1973 | Rainone et al. | |
| 4,398,124 | A | 8/1983 | Kohl et al. | |
| 4,499,404 | A * | 2/1985 | Walsh | H01K 1/46 313/318.05 |
| 4,570,104 | A | 2/1986 | Janssen et al. | |
| 4,742,269 | A * | 5/1988 | Izumiya | H01J 61/827 313/624 |
| 4,985,656 | A * | 1/1991 | Westlund, Jr. | H01K 1/40 106/690 |
| 5,206,799 | A | 4/1993 | Tiesler | |
| 5,900,696 | A * | 5/1999 | Buschmann | H01K 1/18 313/578 |
| 2013/0162136 | A1* | 6/2013 | Baldwin | H01J 1/02 313/311 |
| 2015/0137685 | A1 | 5/2015 | De Santiago et al. | |

FOREIGN PATENT DOCUMENTS

| | | |
|---|---|---|
| JP | H09 45 285 A | 2/1997 |

OTHER PUBLICATIONS

English-language Abstract of JP H09-45285 a obtained from Espacenet website on May 11, 2017 (2 pages).

* cited by examiner

*Primary Examiner* — Joseph L Williams
(74) *Attorney, Agent, or Firm* — Edward S. Podszus

(57) ABSTRACT

A lamp (10) is formed of a lamp capsule (1) sealed with a press seal (2) penetrated by electrical lead-ins (12), the lamp (1) being received in an insulating base (16) that has external electrical pins (18). Power leads (20) interconnect respective capsule lead-ins (12) and base pins (18). Power leads (20) are formed of stranded wire having a plurality of intertwined strands.

5 Claims, 1 Drawing Sheet

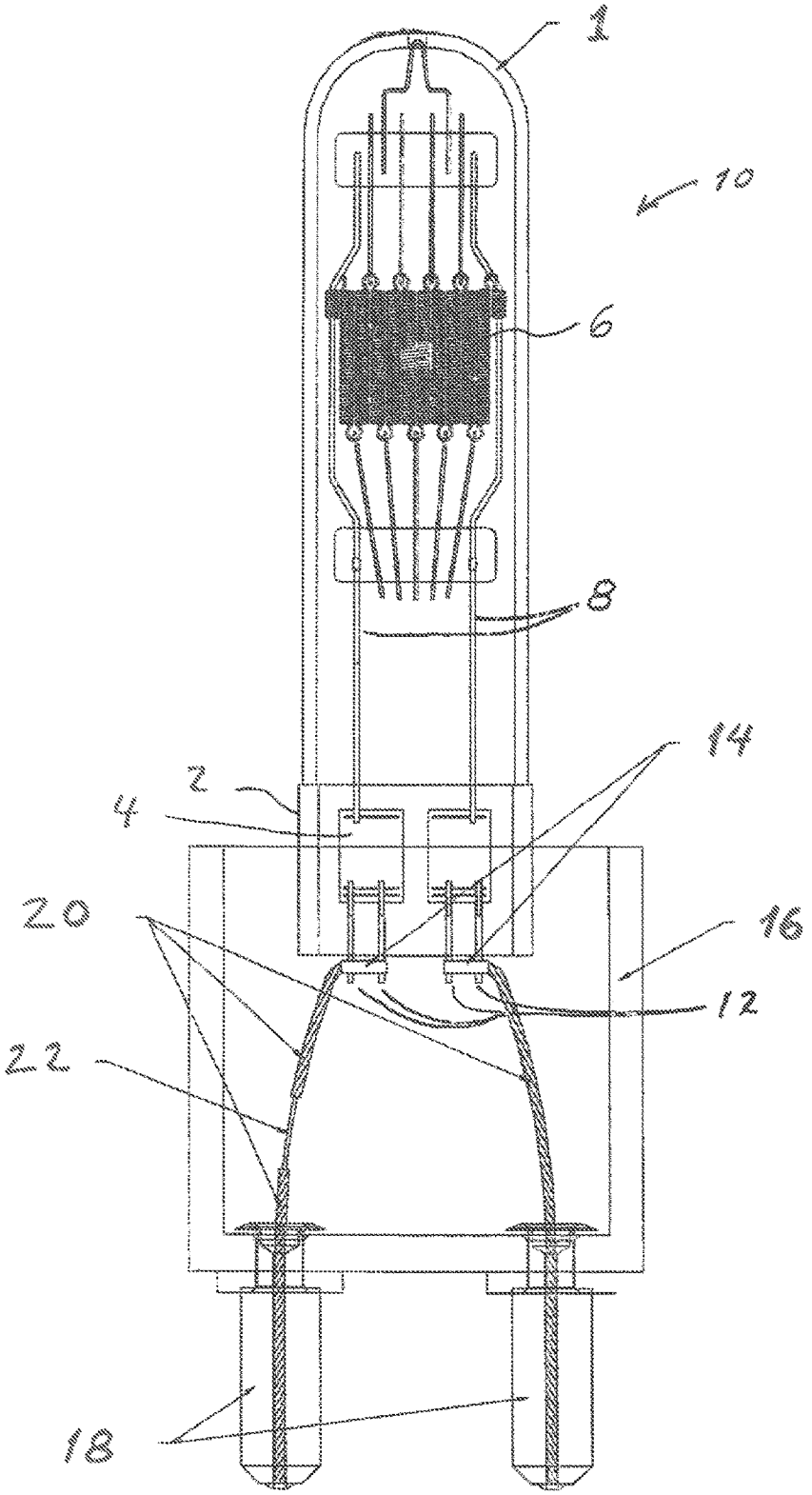
1
10
6
8
14
2
4
20
16
12
22
18

LAMP WITH INTERTWINED STRANDED POWER LEAD

CROSS REFERENCE TO RELATED APPLICATIONS

N/A

TECHNICAL FIELD

The present disclosure relates generally to a high-current lamp capsule with a press seal and power leads connecting the lamp capsule to electrodes of an insulating base.

BACKGROUND AND PRIOR ART

Lamps are known in U.S. Pat. No. 4,398,124 (Kohl) and Pat Appl. Pub. US 2015/0137685 (De Santiago et al.), which are each incorporated in their entirety by reference herein.

Also known are U.S. Pat. Nos. 4,570,104 (Janssen) and 3,733,508 (Rainone).

Lamps of the present type are used in power supplies with dimmers and conventional such lamps can have a high noise or hum level produced by the lamp's use with the electronic dimmer that users find uncomfortable or distracting. With reference to figures and reference numerals in the known lamp illustrated at FIG. 2 in U.S. Pat. No. 4,398,124 (Kohl), the lamp capsule 11 has sealed end 17 through which lead-in wires 19 protrude. The lamp capsule is received in an insulating ceramic base 23 and held by refractory cement; the base 23 has conductive pins 25, 25' to make electrical connection to an appropriate socket; power leads 33, each made of a single solid nickel wire, connect the lead-in wires 19 to the base's conductive pins. In conventional lamps such as those depicted in U.S. Pat. No. 4,398,124 the present inventors herein have observed that the power lead illustrated as nickel wire 33 is a piece of solid wire. Solid wire is a term of art that denotes the wire is formed of a single strand or core of wire. For example, it is known that such solid wire power leads are conventional nickel wire of diameter 0.033 inch (0.84 mm); it is further known that a power lead made of nickel wire of diameter 0.020 inch (0.50 mm) can also be effective as a fuse.

BRIEF DESCRIPTION OF THE DRAWINGS

Reference should be made to the following detailed description, read in conjunction with the following figure, wherein like numerals represent like parts:

FIG. 1 illustrates a front view of a lamp.

For a thorough understanding of the present disclosure, reference should be made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient. Also, it should be understood that the phraseology and terminology used herein is for the purpose of description and should not be regarded as limiting.

DETAILED DESCRIPTION INCLUDING BEST MODE OF A PREFERRED EMBODIMENT

In general, the present disclosure concerns a filament lamp that is sealed with a press seal and having a fuse and received in a ceramic base, as is known in the art such as in the present Assignee's predecessor (GTE) U.S. Pat. No. 4,398,124 (Kohl).

An advantage of the present embodiments has been determined by the present inventors herein that in a construction of the above-mentioned lamp, when power lead wires are made of intertwined stranded wires, also sometimes referred to as cable, instead of a single strand of solid wire as previously known (e.g. wire 33 in Kohl '124 at FIG. 2), a reduction in objectionable lamp humming was observed. It is believed that use of a stranded wire or cable as power lead 20, rather than a conventional solid wire indicated at wire 33 in Kohl '124, is counter to accepted skill in the lamp art since solid wire is easier for assembly of a lamp to shape the component, to pick-and-place it for assembly, and finally to weld or otherwise affix the wire in correct location, since a solid wire strand is generally quite stiff and amenable to handling, such that convention fabrication practice would be understood to reject use of stranded wire as adding complexity and/or cost. Without being bound to any particular theory (and it being understood that possessing one is not a requirement for patentability), inventors presently believe the perceived reduction in humming with use of stranded wires may be (but is not necessarily) due to physical vibration effects such that the multiple strands may cause cancellation of vibration as compared to having one solid wire that vibrates.

FIG. 1 shows a preferred embodiment of a lamp 10 with lamp capsule 1 having a quartz envelope within which is disposed filament 6. Filaments 6, for example coiled coils of tungsten, are supported on internal conductive lead segments 8 which are series connected to inner foils 4 formed in press seal 2. Seal foils 4 are commonly made of molybdenum foil that is welded to inner leads 8, 8, and also welded to external lead-ins 12 that extend through press-seal 2 to a region external of lamp capsule 1.

Base 16 is electrically insulative and preferably of ceramic material, for example that ceramic long known in the art as "Steatite", and is affixed to press seal end 2 by a suitable refractory cement. As is further known in the art, a nickel sleeve 14 joins each anode lead-in 12 (or group of lead-ins 12) and each cathode lead-in 12 (or group of lead-ins 12) to respective power leads 20. Power leads 20 interconnect anode and cathode lead-ins 12 to conductive contact pins 18 of base 16.

Power leads 20 are formed of stranded wire. Stranded wire is understood as a plurality (two or more) strands of wire that are intertwined. Intertwined wire are strands that are twisted, braided, woven, wound, wrapped, or formed as a cable around one another. In sample lamps of the type 2 kW/230V, 2 kW/240V and 2 kW/120V built using, instead of conventional solid wire power leads, power leads 20 formed of nickel plated AWG #16/19 strands, a reduction in noise or bumming level was noticed through empirical acoustic observation. It is understood that AWG #16/19 stranded wire is commonly formed of 19 strands of 0.011 inch (0.28 mm) wire. Suitable wire gauge and size and number of strands is chosen based on choice of wattage and voltage (or current).

A power lead 20 can also incorporate, or be joined to, a fuse 22 in base 16. A suitable fuse 22 is formed as single strand ("solid wire") of nickel of diameter 0.020 inch (0.5 mm). Two segments of stranded power lead 20 can be welded or clamped to opposite ends of a single strand (solid wire) fuse 22. Alternatively, power lead 20 can be formed of numerous intertwined strands of 0.020 inch wire and then locally all but one strand cut away by a blade or knife to form a single-strand region acting as fuse 22. Also alternatively, a simple construction (not shown) can be realized by having a small diameter solid wire fuse 22 located in one of the contact pins 18, thus allowing two similar power lead 20 cables to connect respective contact pins 18 to lead-ins 12.

While several embodiments of the present disclosure have been described and illustrated herein, those of ordinary skill in the art can envision a variety of other means and/or structures for performing the functions and/or obtaining the results and/or one or more of the advantages described herein, and each of such variations and/or modifications is within the scope of the present disclosure. All parameters, dimensions, materials, and configurations described herein are meant to be exemplary and the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, are understood to mean "at least one." The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

An abstract is submitted in order to comply with the rule requiring an abstract to allow examiners to quickly ascertain the general subject matter of the disclosure. It is submitted with the understanding that it will not be used to interpret or limit the scope or meaning of the claims, as set form in the rules of the U.S. Patent and Trademark Office.

The following non-limiting reference numerals are used in the specification:

1 lamp capsule
2 press seal
4 inner foil
6 filament
8 inner conductive leads
10 lamp assembly
12 capsule lead-ins
14 sleeve
16 insulative base
18 base contact pins
20 power lead
22 fuse

What is claimed is:

1. A lamp assembly (10) comprising:

a lamp capsule (1) comprising a filament (6) therein connected to at least one electrical lead-in (12) extending through a press seal (2) to an exterior of the lamp capsule, an insulative base (16) comprising at least one conductive pin (18) extending therefrom, the press seal (2) of the lamp capsule (1) being affixed to the base (16), and at least one power lead (20) disposed in the base (16) and electrically interconnecting the lead-in (12) to the conductive pin (18), wherein the at least one power lead (20) comprises stranded wire having a plurality of intertwined strands.

2. The lamp assembly (10) of claim 1, wherein the at least one power lead (20) comprises stranded wire formed as #16/19 stranded wire.

3. The lamp assembly (10) of claim 1, wherein the at least one power lead (20) is formed as a cable.

4. The lamp assembly (10) of claim 1, wherein the lamp capsule (1) comprises two electrical lead-ins (12), one each formed as an anode and a cathode, the base (16) comprises two conductive pins (18); and the at least one power lead (20) comprises two power leads (20) interconnecting respective pairs of the lead-ins (12) and the conductive pins (18), each power lead (20) comprising standard wire.

5. The lamp assembly (10) of claim 1, wherein the at least one power lead (20) comprises a wire segment formed as a fuse (22).

* * * * *